US006604985B2

(12) United States Patent
Muilenburg et al.

(10) Patent No.: US 6,604,985 B2
(45) Date of Patent: Aug. 12, 2003

(54) ABRASIVE ARTICLE HAVING A WINDOW SYSTEM FOR POLISHING WAFERS, AND METHODS

(75) Inventors: Michael J. Muilenburg, Minneapolis, MN (US); Chong-Yong J. Kim, Shoreview, MN (US); Jerry J. Fizel, River Falls, WI (US); Richard J. Webb, Inver Grove Heights, MN (US); John J. Gagliardi, Hudson, WI (US); Daniel B. Pendergrass, Jr., Mendota Heights, MN (US); Robert J. Streifel, Woodbury, MN (US); Wesley J. Bruxvoort, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 10/289,750

(22) Filed: Nov. 7, 2002

(65) Prior Publication Data

US 2003/0064663 A1 Apr. 3, 2003

Related U.S. Application Data

(63) Continuation of application No. 09/726,064, filed on Nov. 29, 2000.

(51) Int. Cl.[7] ..... B24B 49/00

(52) U.S. Cl. ..... 451/6; 451/10; 451/11; 451/41

(58) Field of Search ..... 451/5, 6, 9, 10, 451/11, 41, 59, 307; 156/345.16, 345.25

(56) References Cited

U.S. PATENT DOCUMENTS

| | | | |
|---|---|---|---|
| 5,219,462 | A | 6/1993 | Bruxvoort et al. |
| 5,380,390 | A | 1/1995 | Tselesin |
| 5,433,651 | A | 7/1995 | Lustig et al. |
| 5,499,733 | A | 3/1996 | Litvak |
| 5,605,760 | A | 2/1997 | Roberts |
| 5,643,046 | A | 7/1997 | Katakabe et al. |
| 5,725,423 | A | 3/1998 | Barry et al. |
| 5,730,642 | A | 3/1998 | Sandhu et al. |
| 5,897,426 | A | 4/1999 | Somekh |
| 5,964,643 | A | 10/1999 | Birang et al. |
| 5,985,679 | A | 11/1999 | Berman |
| 6,014,218 | A | 1/2000 | Bradl et al. |
| 6,068,539 | A | 5/2000 | Bajaj et al. |
| 6,068,540 | A | 5/2000 | Dickenscheid et al. |
| 6,074,287 | A | 6/2000 | Miyaji et al. |

FOREIGN PATENT DOCUMENTS

| | | |
|---|---|---|
| EP | 0 663 265 B1 | 7/1995 |
| EP | 0 738 561 A1 | 10/1996 |
| EP | 0 824 995 A1 | 2/1998 |
| EP | 0 881 040 A2 | 12/1998 |
| EP | 0 881 484 A2 | 12/1998 |
| EP | 0 893 203 A2 | 1/1999 |
| EP | 0 941 806 A2 | 9/1999 |
| WO | WO 98/39142 | 11/1998 |
| WO | WO 99/23449 | 5/1999 |

*Primary Examiner*—Eileen P. Morgan
(74) *Attorney, Agent, or Firm*—Daniel R. Pastirik

(57) ABSTRACT

A process for planarizing, polishing, or providing other modification of a wafer surface or other workpiece. The process includes using an abrasive article having a textured abrasive coating affixed to a backing. The abrasive article includes a monitoring element, such as a window, to allow transmission of radiation therethrough. The radiation level is monitored throughout the planarization process to determine the approach of the desired endpoint. The window in the abrasive coating can be an area devoid of abrasive coating or having minimal or a thinned abrasive coating.

17 Claims, 5 Drawing Sheets

ABRASIVE ARTICLE HAVING A WINDOW SYSTEM FOR POLISHING WAFERS, AND METHODS

This application is a con't of U.S. patent application Ser. No. 09/726,064, filed on Nov. 29, 2000 pending.

The present disclosure relates to an abrasive article used for polishing or otherwise conditioning wafers, such as silicon wafers. In particular, the disclosure relates to abrasive articles having a window system for monitoring the polishing process.

BACKGROUND

In the course of integrated circuit manufacture, a semiconductor wafer typically undergoes numerous processing steps, including deposition, patterning, and etching steps. Additional details on how semiconductor wafers are manufactured can be found in the article "Abrasive Machining of Silicon" by Tonshoff, H. K.; Scheiden, W. V.; Inasaki, I.; Koning. W.; Spur, G. published in the Annals of the International Institution for Production Engineering Research Volume 39/2/1990, pages 621 to 635. At each step in the process, it is often desirable to achieve a pre-determined level of surface "planarity," "uniformity," and/or "roughness." It is also desirable to minimize surface defects such as pits and scratches. Such surface irregularities may affect the performance of the final semiconductor device and/or create problems during subsequent processing steps.

One accepted method of reducing surface irregularities is to treat the wafer surface with a slurry containing a plurality of loose abrasive particles, dispersed in a liquid, and a polishing pad; this is commonly referred to as "planarizing" or "planarization". The planarization process is typically a chemical-mechanical polishing (CMP) process. One problem with CMP slurries, however, is that the process must be carefully monitored in order to achieve the desired amount of planarization. It is important that the planarization process be stopped when the correct thickness of layer material has been removed; that is, when the proper endpoint has been reached. Removing too much of the layer results in loss of wafer yield, which could require redepositing of the circuitry, and not removing a sufficient amount of the layer may require continued planarization. Various methods have been used to attempt to detect the endpoint for stopping the CMP process. These methods include: straight timing, friction, optical results, acoustical results, and conductive characteristics. There have been references related to endpoint detection by chemical analysis; see for example, U.S. Pat. Nos. 6,021,679 and 6,066,564, and PCT Published application WO 99/56972. These references disclose detecting the endpoint by monitoring a chemical reaction product caused by the reaction of a component from the abrasive slurry and the wafer.

Additionally, there have been references that disclose using visual or optical techniques for in-situ monitoring of the CMP process; see for example, U.S. Pat. No. 6,068,538 which discloses using a polishing device having a moveable window positioned below the wafer being processed to view the wafer surface. During polishing, the window is removed from the wafer surface, but is moved to be adjacent the wafer during the visual inspection.

Improvements in real-time endpoint detection methods and processes for determining when the desired level of planarization of the wafers has been obtained, are desired.

SUMMARY OF THE DISCLOSURE

The present disclosure is directed to fixed abrasive articles used for polishing or planarization of semiconductor wafers, and methods of using those abrasive articles for detection of the endpoint of the CMP process.

The abrasive article is a fixed abrasive article having an element or feature therein that allows monitoring of a wafer surface therethrough. By the term "fixed abrasive article", it is meant that the abrasive article has an abrasive coating adhered to a backing or other carrier layer. The monitoring element allows monitoring of the wafer surface through a portion of the abrasive article; this monitoring element can be referred to as a "window". This window may be an area free of abrasive coating, an area having a decreased amount of abrasive coating, or any other area that allows monitoring of the wafer surface through the abrasive article. The benefits of using a fixed abrasive article include the lack of freely moving abrasive particles, such as is encountered when using an abrasive slurry, which can interfere with the endpoint measurements through the monitoring element.

In one embodiment, the window allows transmission of radiation therethrough, the radiation having a decrease of no greater than about 50% as it passes through the window. The term "radiation" is intended to all types of radiation, including electromagnetic radiation, gamma rays, radio frequencies, microwaves, x-rays, infrared radiation, ultraviolet radiation, visible light, and the like. The radiation may be reflected by the wafer surface or may be emitted by the surface. In one embodiment, the window allows transmission of visible light therethrough, the transmission having a decrease no greater than about a 50% as it passes through the window.

In another embodiment, the window allows transmission of radiation therethrough, with the amount of radiation passing therethrough sufficient to allow for quantitative evaluation of changes of the wafer surface. That is, the amount of radiation lost during passing through the window of the abrasive article is irrelevant, as long as the level is sufficient to monitor changes in the wafer surface.

The surface of the wafer can be monitored for changes such as temperature, visible light spectrum patterns, radiation scattering effects, and the like.

The window, through which the wafer surface is monitored, can be continuous along an extended length of abrasive article; for example, the window can extend along the length of a roll of abrasive article. The window can be positioned in essentially the same position along the length of the abrasive article, or the position of the window can vary. In another embodiment, the window is a discrete window bounded by abrasive coating on all sides. Alternately, the abrasive article can have a specific shape and size, such as an abrasive disc; the window can extend from one edge of the abrasive disc to an opposite edge, or the window can be a discrete window bounded by abrasive coating on all sides.

The fixed abrasive article of the present disclosure can be, and preferably is, a textured or three-dimensional abrasive article. By the terms "textured" and "three-dimensional", it is meant that the abrasive coating has a discernible surface pattern. The pattern or texture may be random or precisely placed on the backing. In some embodiments, the abrasive coating is a plurality of abrasive composites on the backing; the abrasive composites may be precisely or irregularly shaped. Preferably, the abrasive composites are precisely shaped. The abrasive composites, whether precisely or irregularly shaped, can be of any geometrical shape defined by a substantially distinct and discernible boundary; such shapes include pyramidal, truncated pyramidal, and the like.

The abrasive coating is a plurality of abrasive particles held to the backing by a binder. The binder can be any material, such as a metal or ceramic binder, but is generally and preferably an organic binder. In most embodiments the binder is formed from a binder precursor. In the embodiments where the binder is an organic binder, the binder is formed by the curing or polymerization of the binder precursor.

In one preferred embodiment, the binder is formed by an addition polymerization, that is, a free-radical or cationic polymerization, of a binder precursor. Additionally, the binder precursor can be polymerized by exposure to radiation or radiant energy, along, if necessary, with an appropriate curing agent. Preferably, the binder precursor includes multi-functional acrylate resin(s), mono-functional acrylate resin(s), or mixtures thereof.

Methods of making an abrasive article having a window are disclosed. Generally, the abrasive article can be made by any method known for making abrasive articles, except that the present disclosure includes the addition of a window within the abrasive coating. The window can be formed by various methods, including: leaving a portion of the backing without the abrasive coating, eliminating the abrasive coating on a portion of the backing after the abrasive coating has been applied, modifying the abrasive coating to provide the desired transmission properties, or removing portions of the abrasive article and applying onto a carrier backing.

Methods of using the abrasive article to planarize the wafer and monitor the endpoint of the planarization process without removal of the abrasive article are also disclosed. The abrasive article is brought into contact with the wafer surface at a desired pressure, preferably in the presence of a coolant or lubricant, such as water or any aqueous or non-aqueous chemistry, and the abrasive article and wafer are moved in relation to each other. After a prescribed period of planarization, the surface of the wafer is optically examined through the window in the abrasive article. In another embodiment, the surface of the wafer can be continuous monitored through the window in the abrasive article.

BRIEF DESCRIPTION OF THE DRAWINGS

Other features, advantages, and further methods of practicing the disclosure will be better understood from the following description of figures and the preferred embodiments of the present disclosure.

DETAILED DESCRIPTION

Figure 1:
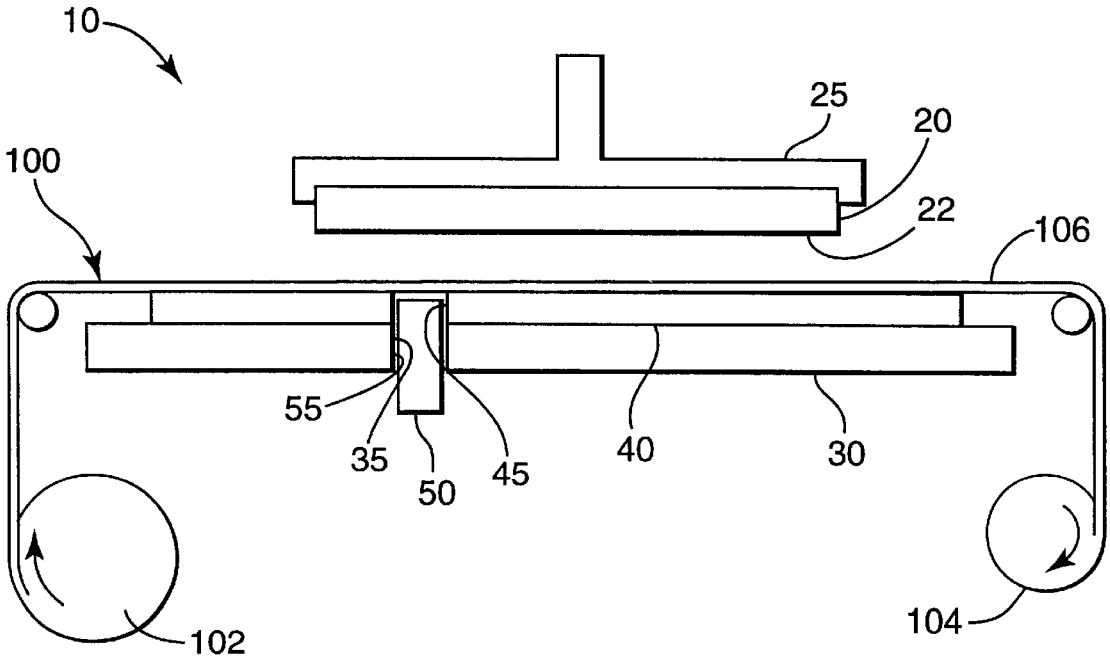
FIG. 1 is a schematic side view of a process for modifying a wafer surface using a fixed abrasive article, according to the present disclosure.

Referring now to the drawings, FIG. 1 illustrates a polishing or planarization process 10 for modifying the surface 22 of a wafer 20, generally a silicon wafer. Surface 22 of wafer 20, as used throughout this disclosure, is intended to include silicon wafers having no circuitry, a wafer having multiple layers of circuitry, and any and all intermediate layers, which include any and all metal and dielectric layers and features. Examples of materials generally polished or planarized by process 10 include, but are not limited to, silicon, silicon oxide, copper, tungsten, and aluminum.

Process 10 is preferably a chemical-mechanical polishing (CMP) process, but it is understood that any device or process capable of modifying a surface of a workpiece can be used in conjunction with the present invention. As shown in FIG. 1, wafer 20, in particular surface 22, is positioned in preparation of being brought into contact with abrasive surface 106 of abrasive article 100. What is desired is to planarize, polish, or otherwise alter or modify surface 22 of wafer 20.

In most embodiments wafer 20 is held by a carrier 25 above abrasive article 100. Abrasive article 100 is supported by a platen 30 on which is positioned a conformable pad 40. Pad 40 supports abrasive article 100 and provides a cushioning effect for abrasive article 100. Generally, pad 40 is a urethane or urethane composite pad, and such pads are well known in wafer processing.

In most embodiments, carrier 25 with wafer 20 rotates in relation to abrasive article 100, however, in some embodiments, carrier 25 and wafer 20 are stationary and abrasive article 100 on pad 40 and platen 30 rotate or otherwise move. In most processes, a coolant or lubricant, such as water, alcohol, oil, or the like, is used at the interface between wafer 20 and abrasive article 100. In some embodiments, the coolant may be an etchant, in that it reacts with or otherwise affects the surface 22.

Platen 30 has an aperture 35 therethrough and pad 40 also has an aperture 45 therethrough. Together, aperture 35 and aperture 45 form receptacle 55 for receiving a measurement sensor 50, which measures a desired characteristic of surface 22 of wafer 20 through abrasive article 100, in particular, through a monitoring element, as will be described in detail below.

Sensor 50 is generally configured to measure radiation such as electromagnetic radiation, gamma rays, radio frequencies, microwaves, x-rays, infrared radiation, ultraviolet radiation, visible light, and the like. This radiation may be either emitted by wafer 20 or may be radiation from a separate source that is reflected by or passed through wafer 20. The changes of radiation levels measured by sensor 50 correlate to the degree of planarization of surface 22 completed by the planarization process.

In another embodiment, sensor 50, combined with any control system or electronic equipment, may be designed to monitor average levels or relative levels of reflection or absorption spectra from the wafer surface 22. For example, if it is known the final desired surface is 25% copper circuitry and 75% dielectric, the levels of reflection or adsorption spectra from the two materials can be monitored until their levels are present in a 1:3 ratio. It is understood that this can be done with any materials and at any percentage levels.

In some embodiments it is desired that sensor 50 is generally flush with the top of pad 40 so that little or no gap exists between sensor 50 and abrasive article 100. Sensor 50 may be removable and replaceable within receptacle 55 to allow for changing sensor 50 as needed.

Sensor 50 is positioned within process 10 so that sensor 50 is aligned with a monitoring element within abrasive article 100 (as will be described below), so that sensor 50 is able to monitor the processing of wafer 20.

Abrasive Article Used for Polishing

In accordance with the present disclosure, the fixed abrasive article 100 used for planarizing, planarization, or otherwise modifying wafer 20 has a monitoring element to allow passage of the radiation therethrough. This monitoring element can be referred to as a "window", in that the monitoring element allows the transmission of radiation through that area of the abrasive article having the monitoring element; the amount of radiation passing through the window should be of a level sufficient so that the sensor 50 is able to qualify and quantify radiation level changes.

The window area of abrasive article 100 is generally an area that is void of abrasive coating 106 or has a decreased amount of abrasive coating thereon. In some embodiments, an abrasive coating is present in the monitoring element area, but the pattern or texture of the abrasive coating is such that it allows sufficient light transmission therethrough. Throughout the planarization process, the window area generally has a constant concentration of abrasive coating. The abrasive coating does not freely move, such as would a loose abrasive slurry or paste. It is understood that occasionally abrasive particles or pieces of coating may break free from the abrasive article; however, this amount will typically not affect or interfere with the transmission of radiation through the monitoring element or window.

Generally, the area of the window is no greater than about 50% of the area of the abrasive article used for the CMP process. In most embodiments, the area of the window is no greater than about 25% of the abrasive article area. In processes where the abrasive article has continuous longitudinal motion in respect to the wafer during the planarization process, the percentage of window area in contact with the wafer surface will generally remain relatively constant as the abrasive article is moved in relation to the wafer.

The monitoring element or window can be continuous along an extended length of abrasive article; for example, the window can extend along the length of a roll of abrasive article. The window can be positioned in essentially the same position along the length of the abrasive article, or the position of the window can vary in respect to an edge of the abrasive article. In an alternative embodiment, the window is a discrete window bounded by abrasive coating and does not extend the length of the abrasive article. Another embodiment is to have a window extend across the width of an abrasive article.

Figure 2:
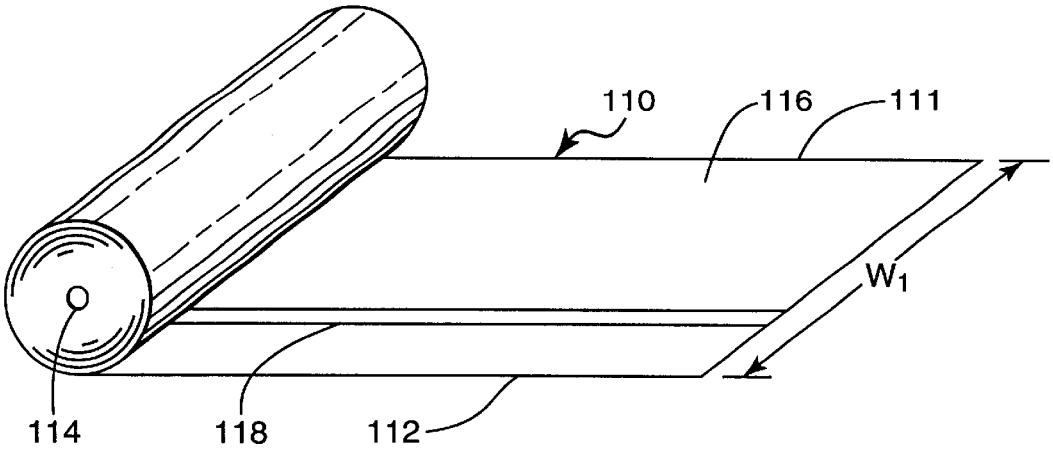
FIG. 2 is perspective view of one embodiment of an abrasive article according to the present disclosure.
Figure 3:
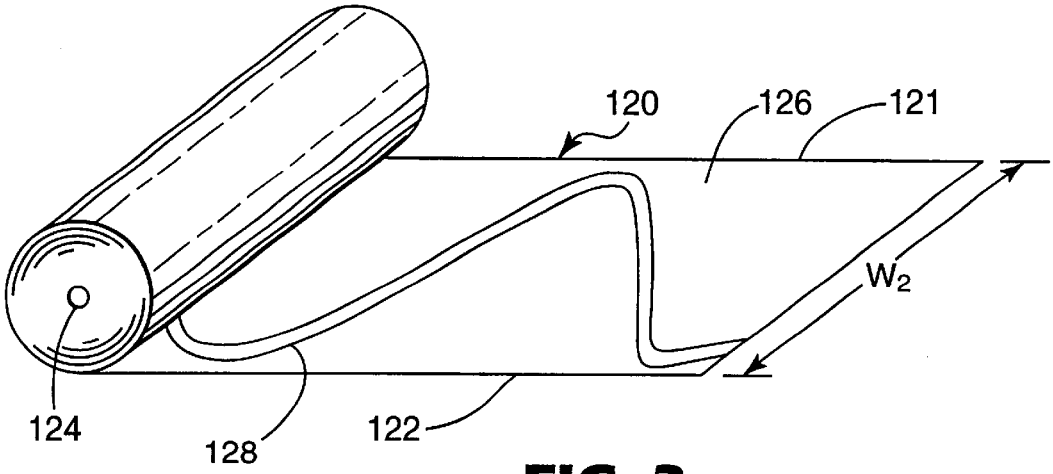
FIG. 3 is a perspective view of a second embodiment of an abrasive article according to the present disclosure.

Referring now to FIGS. 2, 3, 4 and 5, four variations of abrasive articles having an extended length are shown. In FIGS. 2 and 3, the windows are continuous along the length of the abrasive article, in FIG. 4, the windows are individual discrete windows, and in FIG. 5 the windows extend across the width of the abrasive article.

In FIG. 2, an extended length of abrasive article 110 having a width W1 between first side edge 111 and second side edge 112 is shown rolled on a spool or core 114. Abrasive article 110 has an abrasive coating 116 on a backing (not shown). Extending along the length of abrasive article 110 is an elongate window 118. Window 118 has characteristics that allow for the transmission of radiation through window 118 with no more than approximately a 50% decrease in transmission properties. In another embodiment, window 118 allows sufficient transmission of radiation therethrough to enable detection of differences in the radiation reflectance or emission. The distance between window 118 and second side edge 112 along the length of abrasive article 110 is essentially constant.

In FIG. 3, an extended length of abrasive article 120 having a width W2 between first side edge 121 and second side edge 122 is shown rolled on a spool or core 124. Abrasive article 120 has an abrasive coating 126 on a backing (not shown). Extending along the length of abrasive article 120 is an elongate window 128. The distance between window 128 and second side edge 122 varies along the length of abrasive article 120. Window 128 is a sinusoidal pattern extending the length of abrasive article 120.

Figure 4:
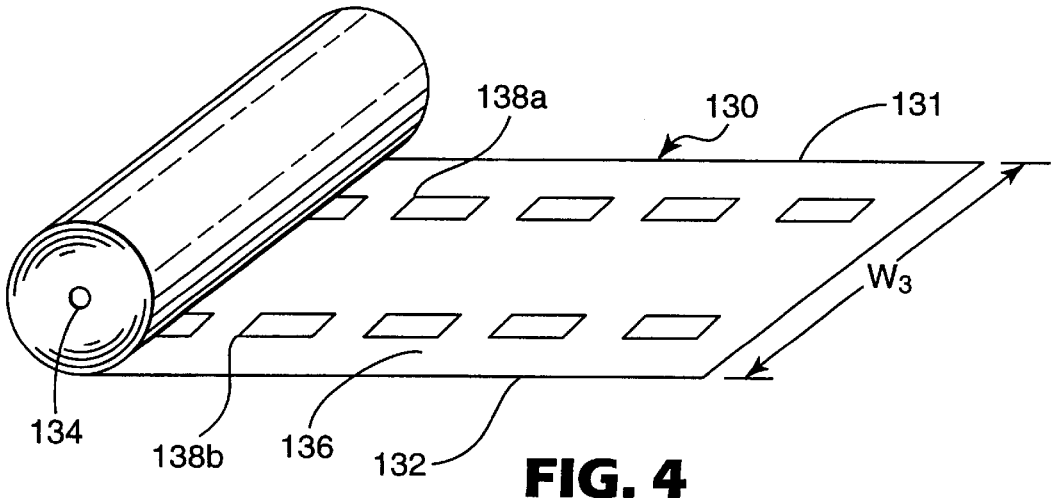
FIG. 4 is a perspective view of a third embodiment of an abrasive article according to the present disclosure.

In FIG. 4, an extended length of abrasive article 130 having a width W3 between first side edge 131 and second side edge 132 is shown rolled on a spool or core 134. Abrasive article 130 has an abrasive coating 136 on a backing (not shown). Extending along the length of abrasive article 130, in close proximity to first side edge 131 and second side edge 132, are discrete windows 138*a* and 138*b*. The distance between window 138*a* and first side edge 131 along the length of abrasive article 130 is essentially constant, and the distance between window 138*b* and second side edge 138*b* is essentially constant.

Figure 5:
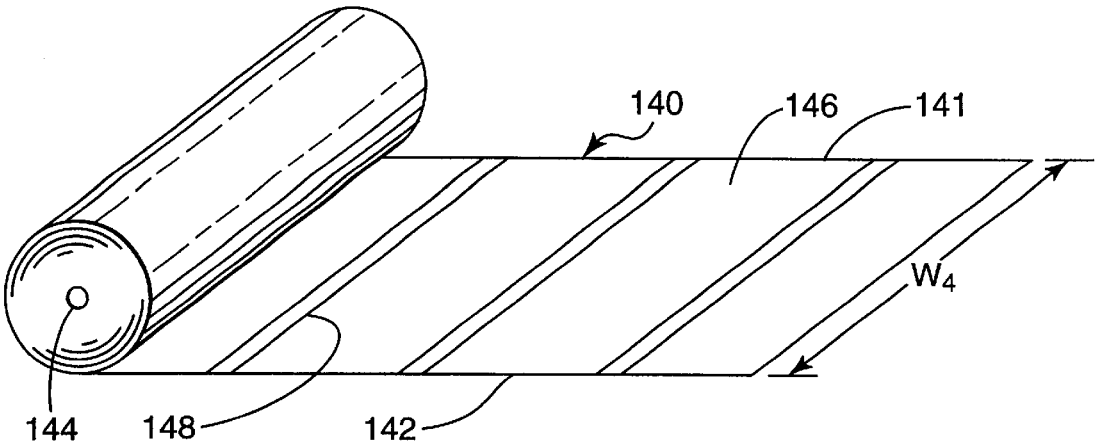
FIG. 5 is a perspective view of a fourth embodiment of an abrasive article according to the present invention.

In FIG. 5, an extended length of abrasive article 140 having a width W4 between first side edge 141 and second side edge 142 is shown rolled on a spool or core 144. Abrasive article 140 has an abrasive coating 146 on a backing (not shown). Extending between first side edge 141 and second side edge 142 are discrete windows 148.

FIGS. 6 through 10 show various embodiments of specifically shaped abrasive articles, in particular, abrasive discs, having at least one window therein. Although five various embodiments of abrasive discs with windows are shown, it is understood that the abrasive article can be any shape, such as a square, rectangle, "daisy" shaped, and other shapes, and that the window or windows can be positioned in any orientation on the abrasive article. It is further understood that any window can have any shape.

Figure 6:
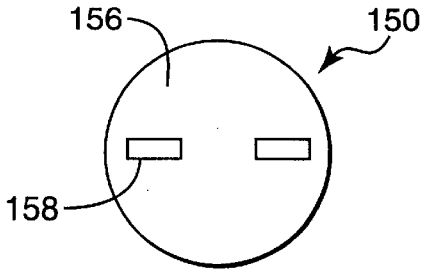
FIG. 6 is a top view of a fifth embodiment of an abrasive article according to the present invention.

Referring now to FIG. 6, an abrasive article 150 is shown. Abrasive article 150 has an abrasive coating 156 and two windows 158. Windows 158 are rectangular windows and are positioned with their long axes aligned. Windows 158 are positioned fairly close to the outer edge of abrasive article 150.

The process according to the present invention may include one sensor 50 (referring again to FIG. 1) for each abrasive article, or may include multiple sensors 50, such as one sensor 50 for each window 158, as shown in FIG. 6. It is not necessary that each of the multiple sensors is aligned with a window 158 at all instances; rather, in some embodiments, only one sensor may be aligned within a window to provide an endpoint monitoring reading. As the abrasive article shifts or progresses across platen 30 and pad 40, another sensor 50 will typically align with its respective window 158. It is understood that continuous monitoring is not required, that is, with a sensor aligned with a window at all periods during the planarization or polishing. Rather, as long the interval between alignment of the window and the sensor is short with respect to the total planarization or polishing time, intermittent monitoring is acceptable.

Figure 7:
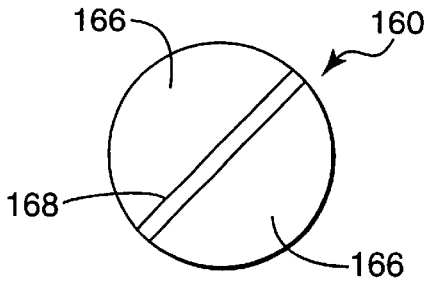
FIG. 7 is a top view of a sixth embodiment of an abrasive article according to the present invention.

In FIG. 7, an abrasive article 160 having an abrasive coating 166 and a single window 168 is shown. Window 168 is a narrow strip that extends across the diameter of abrasive article 160.

Figure 8:
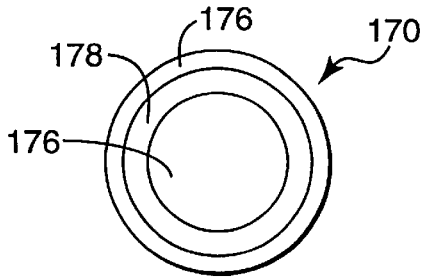
FIG. 8 is a top view of a seventh embodiment of an abrasive article according to the present invention.

An abrasive article 170 having an abrasive coating 176 and a circular or ring-like window 178 is shown in FIG. 8. Window 178 is displaced from the edge of abrasive article 170 an equal distance around the circumference of abrasive article 170. Abrasive coating 176 is present both inside and outside of the ring window 178.

Figure 9:
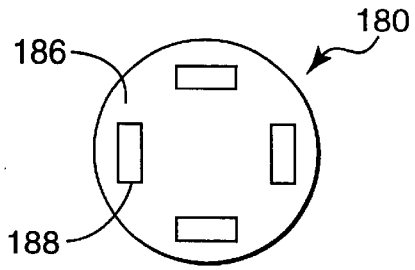
FIG. 9 is a top view of a eighth embodiment of an abrasive article according to the present invention.
Figure 10:
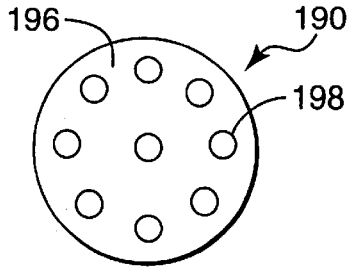
FIG. 10 is a top view of a ninth embodiment of an abrasive article according to the present invention.

In FIG. 9, the windows 188 are similar to rectangular windows 158 of abrasive article 150 of FIG. 6, except that in FIG. 9, abrasive article 180 has four windows 188 positioned equally spaced along the circumference of abrasive article 180. Windows 180 are positioned so that their minor axes are aligned and intersect at a right angle in the center of the abrasive article 180. It is understood that in some embodiments, multiple window 180 may not be equally spaced along the circumference or edge of the abrasive article.

In each of the embodiments shown in FIGS. 2 through 10, the window in the abrasive article is an area within the abrasive article that is free of abrasive coating, an area having a decreased amount of abrasive coating, or any other area that allows for monitoring of the wafer surface through the abrasive article. In one embodiment, the window allows radiation transmission therethrough, the transmission having a decrease of no greater than about 50% caused by the window. It should be noted that the backing is present in the area of the window.

The abrasive article of the present invention is preferably a textured or three-dimensional abrasive article; it is called a "three dimensional" abrasive article because it has a three-dimensional abrasive coating generally formed by an array of individual abrasive composites each having abrasive particles dispersed in a binder system. It is preferred that the composites are three dimensional, having work surfaces which do not form part of an integral layer, thus providing portions of the abrasive coating that are recessed from the working surface. These recesses provide room for debris removal and provide room for fluid interaction between the abrasive article and wafer surface.

The abrasive article used in this disclosure may be a so called "structured abrasive article". A structured abrasive article means an abrasive article having a plurality of individual shaped composites, such as precisely-shaped composites, positioned on a backing, each composite comprising abrasive particles dispersed in a binder.

Other examples of three-dimensional abrasive articles usable for the method of the present disclosure include: (1) "beaded-type abrasive articles" which have beads (generally spherical and usually hollow) of binder and abrasive particles; these beads are then bonded to a backing with a binder; (2) abrasive agglomerates bonded to a backing, where the abrasive agglomerates include abrasive particles bonded together with a first binder; these agglomerates are then bonded to a backing with a second binder; (3) abrasive coating applied by rotogravure roll or other embossed roll; (4) abrasive coating applied through screen to generate a pattern; (5) abrasive coating on a contoured or embossed backing. These examples are not limiting to the types of three-dimensional abrasive articles that can be used for the abrasive articles and the various methods of the present invention; rather, the list provided is merely a sampling of abrasive articles that have a three-dimensional or textured coating. Various other methods to provide abrasive coatings having a texture can used, and these abrasive articles can be used in the present planarization method.

Figure 11:
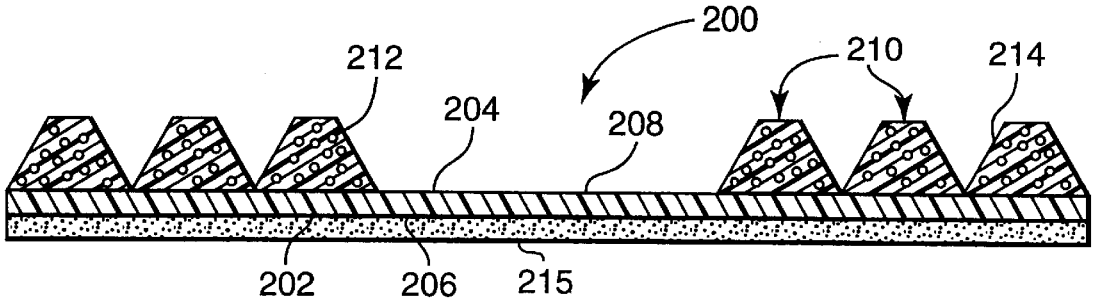
FIG. 11 is an enlarged cross-sectional view of one embodiment of an abrasive article according to the present invention.

Various three-dimensional, fixed, abrasive articles in accordance with the present invention will be described in detail in relation to FIGS. 11, 12 and 13. Referring to FIG. 11, one embodiment of a three-dimensional abrasive article 200 is illustrated. Abrasive article 200 has a backing 202 having a front surface 204 and a back surface 206. An abrasive coating, in this embodiment a plurality of individual abrasive composites 210, is bonded to front surface 204 of backing 202. The abrasive composites 210 include abrasive particles 212 dispersed in a binder 214. The abrasive composites 210 have a precise shape, shown here as truncated pyramids. On the back surface 206 is an attachment layer 215, such as a pressure-sensitive adhesive, that is used to secure abrasive article 200 to a surface of the platen (as shown in FIG. 1).

Abrasive article 200 also has an associated monitoring element, such as window 208, which is positioned between abrasive composites 210 on backing 202 and is void of abrasive coating.

Figure 12:
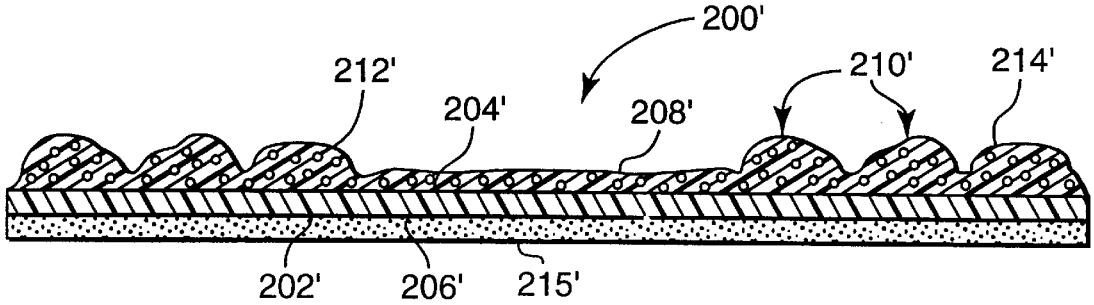
FIG. 12 is an enlarged cross-sectional view of an alternative embodiment of an abrasive article according to the present invention.

Referring to FIG. 12, another embodiment of a three-dimensional abrasive article 200' is illustrated. Abrasive article 200' has a backing 202' having a front surface 204' and a back surface 206'. An abrasive coating, in this embodiment a plurality of individual abrasive composites 210' having an imprecise or irregular shape, is bonded to the front surface 204 of the backing 202'. The irregular abrasive composites 210' are not bounded by well-defined shaped edges with distinct edge lengths having distinct endpoints, as are the composites 210 of abrasive article 200 of FIG. 11. Rather, the abrasive composites 210' are slumped composites of abrasive particles 212' dispersed in a binder 214'. On the back surface 206' of backing 202' is an attachment layer 215', such as a pressure-sensitive adhesive.

Abrasive article 200' also has a monitoring element, shown as window 208'. Window 208' is positioned between abrasive composites 210' on backing 202' and includes a thin or thinned layer of abrasive coating on first surface 204'. The abrasive coating present in the area of window 208' is sufficiently thin to allow sufficient radiation transmission through window 208'. In most embodiments, abrasive particles are present in the thinned layer of abrasive coating.

Figure 13:
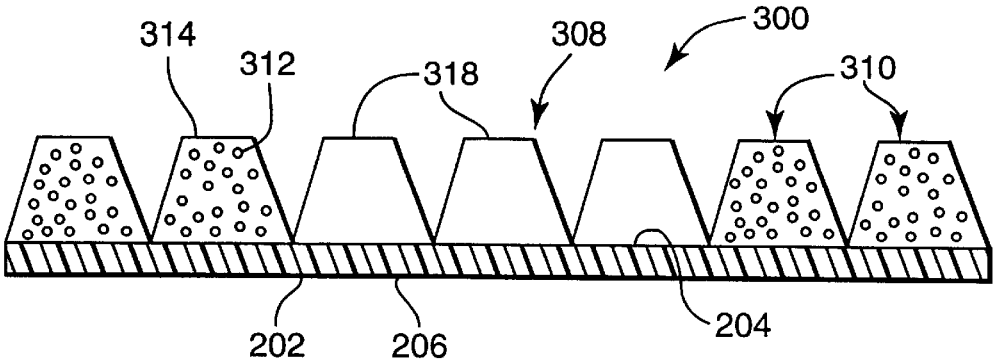
FIG. 13 is an enlarged cross-sectional view of yet an another alternative embodiment of an abrasive article according to the present invention.

Referring to FIG. 13, yet another embodiment of a three-dimensional abrasive article 300 is illustrated. Abrasive article 300 has a backing 302 having a front surface 304 and a back surface 306. An abrasive coating, in this embodiment a plurality of precisely shaped individual abrasive composites 310, is bonded to the front surface 304 of the backing 302. Similar to the other abrasive composites, composites 310 comprise abrasive particles 312 dispersed in a binder 314.

Abrasive article 300 also has a monitoring element, such as a window 308. Window 308 is positioned on front surface 304 of backing 302 between abrasive composites 310. The area of window 308 includes a plurality of precisely shaped individual structures 318. Structures 318 have a similar shape to abrasive composites 310, however, structures 318 generally do not include abrasive particles 312. Rather, structures 318 may be optically clear at least partially transparent, in order to allow passage of light or other radiation therethrough. In some embodiments, it is desired that structures 318 have a refractive index similar to that of any coolant or liquid that is present at the abrasive article-wafer interface. In another embodiment, structures 318 can be water soluble structures which soften and dissolve upon contact with any coolant used during the planarization process.

The various embodiments of abrasive articles shown in FIGS. 2 through 13 can be made by a variety of methods, as will be described below. However, prior to describing methods of making the abrasive articles, the various elements of the abrasive articles will be described.

As understood, the abrasive article of the present invention is a fixed abrasive article, meaning that the abrasive coating is present on a backing. The backing used can be any backing material generally used for abrasive articles, such as polymeric film (including primed polymeric film), cloth, paper, nonwovens (including lofty nonwovens), treated versions thereof and combinations thereof. Generally, metal backings are not used because of their resistance to passage of radiation therethrough. The backing can have a treatment to improve the adhesion of the abrasive coating onto the backing. Paper and cloth backings can have a water proofing treatment so that the backing does not appreciably degrade during the planarization or polishing operation, as some water is used during the process. In one preferred embodiment, the backing is at least partially transparent to visible light, so that at least some amount of visible light is able to be transmitted through the backing.

The backing can have one half of an attachment system on its back surface to secure the abrasive article to the support pad or back-up pad. This attachment system half can be a pressure sensitive adhesive (PSA) or tape, a loop fabric for a hook and loop attachment, a hook structure for a hook and loop attachment, or an intermeshing attachment system.

The abrasive article can have any suitable shape, such as round, oval or rectangular depending on the particular shape of the lap pad (that is, the support pad) being employed. In many instances, the abrasive article will be slightly larger in size than the lap pad. In some embodiments, the abrasive article is provided as an extended length on a roll or reel. An abrasive article may be formed into an endless belt by conventional methods by splicing the abutted ends of an elongated strip of the sheet material. Additionally, the abrasive article may be die cut and/or slit to any desired configuration or shape.

The abrasive coating of the abrasive article includes abrasive particles dispersed in a binder. The abrasive particles are preferably aluminum oxide (alumina), silicon oxide (silica), cerium oxide (ceria), rare earth compounds, or mixtures thereof, although it is understood that any abrasive particle can be used. The particular abrasive particle used will generally depend on the material being polished or planarized. Examples of rare earth compounds suitable for planarization can be found in U.S. Pat. No. 4,529,410 (Khaladji et al.). It is believed that some abrasive particles may provide a chemo-mechanical element to the planarization procedure. As used herein, chemo-mechanical refers to a dual mechanism where corrosion chemistry and fracture mechanics both play a role in wafer polishing. In particular, it is believed that abrasive particles such as cerium oxide and zirconium oxide, for example, provide a chemical element to the polishing phenomenon for $SiO_2$ substrates.

The abrasive particles may be uniformly dispersed in the binder or alternatively the abrasive particles may be non-uniformly dispersed. It is preferred that the abrasive particles are uniformly dispersed so that the resulting abrasive coating provides a consistent cutting/polishing ability.

The average size of the abrasive particles is at least about 0.001 micrometer; the average size is no greater than about 20 micrometers. Typically, the average size is about 0.01 to 10 micrometers. In some instances, the abrasive particles preferably have an average particle size less than 0.1 micrometer. In other instances, it is preferred that the particle size distribution results in no or relatively few abrasive particles that have a particle size greater than about 2 micrometers, preferably less than about 1 micrometer and more preferably less than about 0.75 micrometer. At these relatively small particle sizes, the abrasive particles may tend to aggregate by interparticle attraction forces. Thus, these aggregates may have a particle size greater than about 1 or 2 micrometers and even as high as 5 or 10 micrometers. It is then preferred to break up these aggregates to an average size of about 2 micrometers or less. In some instances, it is preferred that the particle size distribution be tightly controlled such that the resulting abrasive article provides a very consistent surface finish on the wafer surface.

To form an abrasive composite or coating, the abrasive particles are dispersed in a binder precursor to form an abrasive slurry, which is then exposed to an energy source to aid in the initiation of the polymerization or curing process of the binder precursor. Examples of energy sources include thermal energy and radiation energy, which includes electron beam, ultraviolet light, and visible light. The cured binder precursor forms the binder.

Examples of suitable binder precursors which are curable via an addition (chain reaction) mechanism include binder precursors that polymerize via a free radical mechanism or, alternatively, via a cationic mechanism. These binder precursors include acrylated urethanes, acrylated epoxies, ethylenically unsaturated compounds including acrylate monomer resin(s), aminoplast derivatives having pendant $\alpha,\beta$-unsaturated carbonyl groups, isocyanurate derivatives having at least one pendant acrylate group, isocyanate derivatives having at least one pendant acrylate group, epoxy resins, vinyl ethers, and mixtures and combinations thereof. The term acrylate encompasses acrylates and methacrylates.

Various methods for producing abrasive articles having either precisely or irregularly shaped abrasive composites are taught, for example, in U.S. Pat. No. 5,152,917 (Pieper et al.), U.S. Pat. No. 5,435,816 (Spurgeon et al.), U.S. Pat. No. 5,667,541 (Klun et al.), U.S. Pat. Nos. 5,876,268 and 5,989,111 (Lamphere et al.), and U.S. Pat. No. 5,958,794 (Bruxvoort et al.), each of which is incorporated herein by reference.

Figure 14:
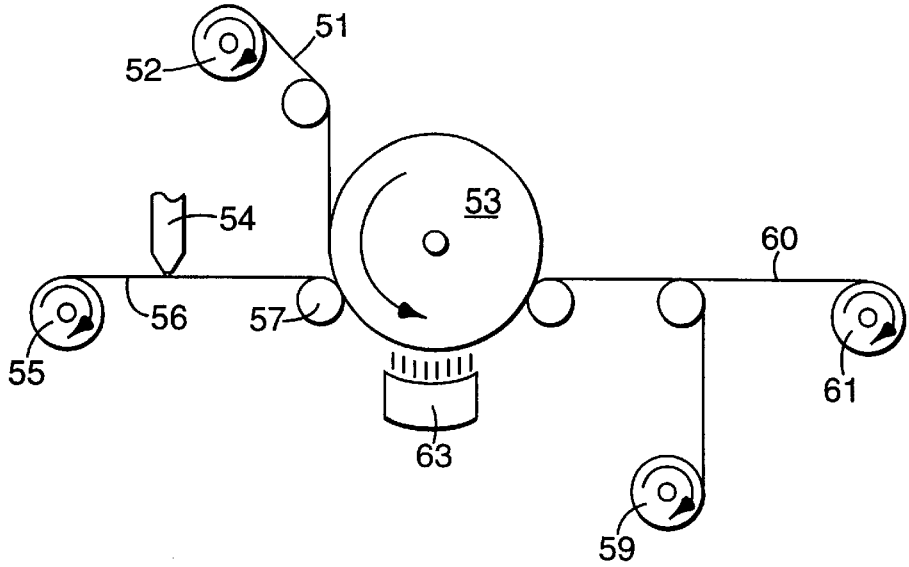
FIG. 14 is a schematic side view of a system for making an abrasive article such as those depicted in FIGS. 2 through 13.

FIG. 14 is a schematic illustration of one method of manufacturing an abrasive article having abrasive composites and a monitoring element, such as a window. Generally the first step to making the abrasive article is to prepare the abrasive slurry, which is made by combining together by any suitable mixing technique the binder precursor, the abrasive particles and any optional additives. Examples of mixing techniques include low shear and high shear mixing, with high shear mixing being preferred. Pulling a vacuum during the mixing step can minimize the presence of air bubbles in the abrasive slurry. The abrasive slurry should have a rheology that coats well and in which the abrasive particles and other additives do not settle out of the abrasive slurry. Any known techniques to improve the coatability, such as ultrasonics or heating can be used.

To obtain an abrasive composite with a precise shape, the binder precursor is solidified or cured while the abrasive slurry is present in cavities of a production tool. To form an abrasive composite which has an irregular shape, the production tool is removed from the binder precursor prior to curing, resulting in a slumped, irregular shape.

One method of producing a three dimensional abrasive article is illustrated in FIG. 14. Backing 51 leaves an unwind station 52 and at the same time a production tool (cavitied tool) 56 leaves an unwind station 55. Production tool 56 is coated with abrasive slurry by means of coating station 54 so that the cavities are at least partially filled with abrasive slurry. The coating station can be any conventional coater such as drop die coater, knife coater, curtain coater, vacuum die coater, or a die coater. It may be desired to minimize the formation of air bubbles during coating. One coating technique is a vacuum fluid bearing die, such as described in U.S. Pat. Nos. 3,594,865; 4,959,265 and 5,077,870.

After the production tool 56 is filled, backing 51 and the abrasive slurry on production tool 56 are brought into contact so that the abrasive slurry wets the front surface of backing 51. In FIG. 14, the abrasive slurry filled tool 56 is brought into contact with backing 51 by a contact nip roll 57. Next, contact nip roll 57 also forces the resulting construction against support drum 53. Next, some form of radiant energy is transmitted into the abrasive slurry by energy source 63 to at least partially cure the binder precursor. The production tool 56 can be transparent material (such as polyester, polyethylene or polypropylene) to transmit visible or UV radiation to the slurry contained in the cavities in production tool 56 as tool 56 and backing 51 pass over roll 53. The term "partially cure" means that the binder precursor is polymerized to such a state that the abrasive slurry does not flow when the abrasive slurry is removed from production tool 56. The binder precursor can be fully cured by any energy source after it is removed from the production tool, if desired. The abrasive article 60 (comprising backing 51 and the at least partially cured abrasive slurry) is removed from production tool 56 and tool 56 is rewound on mandrel 59 so that production tool 56 can be reused again. Additionally, abrasive article 60 is wound on mandrel 61. If the binder precursor is not fully cured, the binder precursor can then be fully cured by either time and/or exposure to an energy source such as radiant energy.

In another variation of this first method, the abrasive slurry can be coated onto the backing rather than into the cavities of the production tool. The abrasive slurry coated backing is then brought into contact with the production tool such that the abrasive slurry flows into the cavities of the production tool. The remaining steps to make the abrasive article are the same as detailed above. Other variations include using a continuous belt or a drum as a production tool.

The cavities in the product tool provide the inverse shape of the three dimensional composites in the abrasive article. Additionally, the cavities provide a close approximation of the size of the abrasive composites. One example of a three-dimensional composite includes a truncated pyramid about 914 micrometers tall, about 2030 micrometers wide at the base, and about 635 micrometers wide at the distal end.

Additional details on the use of a production tool to make a three-dimensional abrasive article according to these methods are further described in U.S. Pat. No. 5,152,917 (Pieper et al.) and U.S. Pat. No. 5,435,816 (Spurgeon et al.), both of which are incorporated herein by reference.

The window in the abrasive article can be made by any number of methods. The window may be made by preventing application of the abrasive composites to the desired area, or removal of abrasive composites (or uncured or partially cured abrasive composites) from the desired area. Yet further, a window can be made by altering the composition of the composites in the desired window area.

In the first general method, either no or very little abrasive slurry is provided to the area where the eventual window is desired. In a first embodiment, the production tool may be void of cavities in the area where the window is desired, thus resulting in little or no abrasive slurry positioned in that area. Abrasive slurry would be coated over the expanse of tooling, including the area devoid of cavities. When the slurry coated tooling is contacted with the backing, no slurry or very little slurry transfers to the backing in that area devoid of cavities. It is understood that instead of having a backing that is devoid of cavities, it is also possible to have a portion of the cavities filled with a material so that the abrasive slurry cannot enter the cavities. The cavities can be permanently filled, for example with a material such as a epoxy, or can be temporarily filled, for example, with wax or a water soluble material.

In a variation of this first embodiment, abrasive slurry can be coated over the expanse of a backing. When the slurry coated backing is contacted with the production tooling and the cavities, the area devoid of cavities will not result in composites; rather, that area will have little or no abrasive slurry present. These methods can provide any or all of the abrasive articles of FIGS. 2 through 12.

Figure 15:
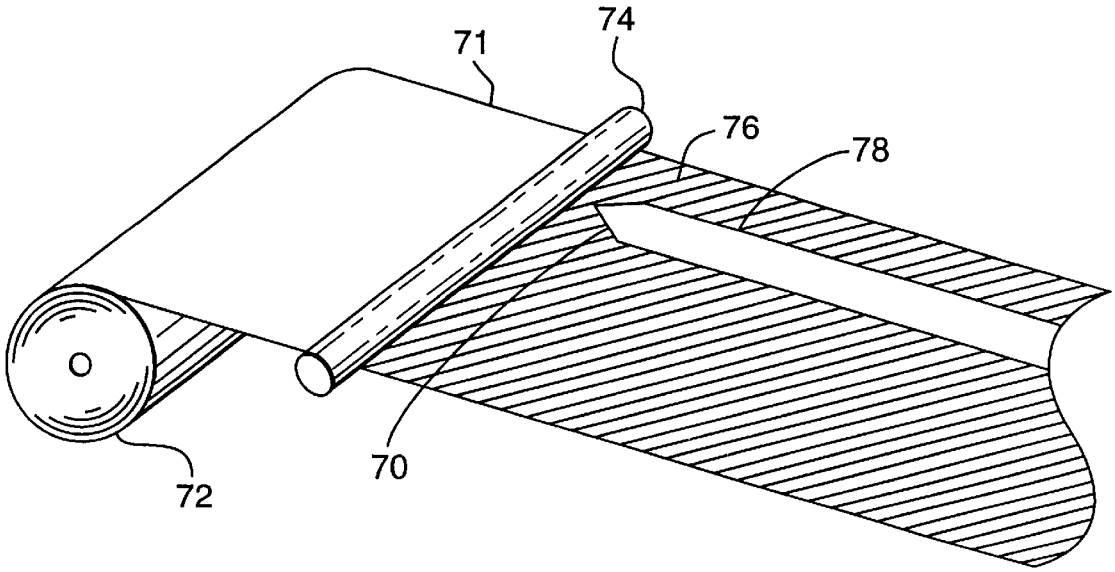
FIG. 15 is a schematic perspective view of a system an abrasive article such as those depicted in FIGS. 2 and 7.

In another embodiment, the production tool has cavities throughout, but no abrasive slurry is provided to the cavities in the desired window area. This may be done in any number of ways. For example, if it is desired that the window extend from one edge of the abrasive article to another edge, such as in abrasive article 110 of FIG. 2 or abrasive article 160 of FIG. 7, the coating die used to apply the slurry to the production tool or the backing may be blocked in the desired area. For example, one or more delivery ports from the die may be blocked to provide a width of the die that does not provide a coating of the abrasive slurry. This method may be used for coating processes that use a rolling bank or bead of slurry or for process that do not use the bank or bead. As another example, a dam or other blocking device may be positioned in the area where the extended window is desired. Thus, although slurry exits the coating die, the slurry is redirected away from the area of the window. Referring to FIG. 15, an extended length of backing 71 is provided on roll 72. Backing 71 progresses under coating die 74, which applies abrasive slurry across the width of backing 71. A slurry diverter 70 is positioned downweb of coating die 74, thus diverting a portion of the abrasive slurry. The slurry coated area 76, after the abrasive slurry has been cured, will provide abrasive coating 116 of abrasive article 110 of FIG. 2 and abrasive coating 166 of abrasive article 160 of FIG. 7. Area 78, free of abrasive slurry, will provide window 118 of abrasive article 110 and window 168 of abrasive article 160.

In another embodiment, either the backing or the production tool, typically the backing, is treated with a surface coating or similar feature to minimize the amount of abrasive slurry that adheres thereto. Conversely, if a primer to improve the adhesion of the abrasive slurry to the backing is used, this primer can be removed or not applied to areas where a window is desired, thus minimizing the amount of abrasive slurry that adheres thereto.

In a second general method, the abrasive slurry is removed from the backing after the composites have been molded; the slurry can be removed either prior to being cured or after being at least partially cured. In a first embodiment, the abrasive slurry or abrasive composites can be scraped off from the backing after being shaped into composites. This may be done by a knife, blade, or any item that will remove the desired material. For example, a knife oscillating across the width of the coated backing as the backing is moving in its longitudinal direction will provide an abrasive article such as abrasive article 120 of FIG. 3.

In another embodiment, the backing, prior to being coated with abrasive slurry, can have patches or stripes that are removable; a pressure-sensitive adhesive tape can be used as the patch or stripe material. After the composites are provided on the surface of the patches or stripes, they can be removed, thus also removing the composites.

In yet another embodiment, the desired window area can be masked after the composites are molded but before cured. The unmasked area can be exposed to conditions to cure the slurry. The masked, uncured area can be removed, for example, by a solvent, such as water if the uncured slurry is water soluble.

In a further embodiment, a continuous abrasive coating can be provided on the backing and cured to form an abrasive article. Prior to use in a planarization or polishing process, sections of the abrasive article, including both the backing and the abrasive coating thereon, can be removed, leaving a discontinuous abrasive article. This discontinuous abrasive article can be positioned, for example by lamination, on a carrier backing. The areas from which the sections were removed will be the window area of the abrasive article during the wafer processing. To clarify this embodiment, two detailed examples are provided. In the first example, an abrasive article having a continuous abrasive coating on a backing is slit to provide thin, elongate sections. These sections are positioned on a carrier backing so that the abrasive sections have non-abrasive sections therebetween. The areas where only the carrier backing is present are the monitoring elements or windows that provide transmission of radiation therethrough. These windows extend the length of the abrasive article. As a second example, an abrasive article having a continuous abrasive coating on a backing is die cut or punched to provide discrete areas void of abrasive article. That is, the abrasive article has holes or apertures therethrough. The abrasive article is positioned on a carrier backing, and the areas having the holes or apertures are the monitoring elements or windows that would provide transmission of radiation therethrough. With this process of making the windowed abrasive article, the abrasive article has two backings (i.e., the abrasive backing and the carrier backing) in the areas having the abrasive coating, and the areas of the monitoring element have one backing (i.e., the carrier backing).

Referring again to the figures, a monitoring element, such as window 308 of abrasive article 300 in FIG. 13, can be made by coating two different slurry compositions onto the backing. The composition provided to the window area has less, preferably no, abrasive particles. Alternately, the binder used to form the composites can be varied. An abrasive article made from two or more different slurries can be made by the teachings of U.S. Pat. No. 6,080,215 (Stubbs et al.), which is incorporated herein by reference.

In another example, an abrasive article can be made having a decreased density of abrasive composites in the monitoring element or window area. For example, the spacing between adjacent composites may be greater, or the shape of the composites may differ to allow more passage of radiation therethrough. In another embodiment, the height of the abrasive composites may be significantly less, almost to the point of resembling window 208' of FIG. 12.

Although the majority of the description above has been directed to using a cavitied tool to make the abrasive composites, it is understood that other methods for making textured or three-dimensional coatings can be used. For example, gravure roll coating or other coating techniques can make abrasive articles having a monitoring element or window area. One skilled in the art of abrasive articles will derive additional methods for making abrasive articles having a monitoring element therein. No matter how constructed or manufactured, the abrasive article of the present invention includes an area through which processing of a workpiece, such as a wafer, can be monitored.

The complete disclosures of all patents, patent applications, and publications listed herein are incorporated by reference as if individually incorporated. Various modifications and alterations of this invention will become apparent to those skilled in the art without departing from the scope and spirit of this invention, and it should be understood that this invention is not to be unduly limited to the illustrative embodiments set forth herein.

We claim:

1. A method of modifying a workpiece surface comprising:

(a) contacting the workpiece surface with an abrasive article, the abrasive article comprising:

(i) a textured abrasive coating comprised of a plurality of abrasive composites, each composite comprised of a plurality of abrasive particles dispersed in a binder, the abrasive composites adhered to a backing, the backing comprising a material at least partially transparent to visible light;

(ii) a monitoring element for passage of radiation therethrough the monitoring element comprising an area of the textured abrasive coating at least partially thinned;

(b) moving the abrasive article in relation to the workpiece surface to modify the workpiece surface; and (c) determining a degree of surface modification by:

(i) measuring a first radiation level from the workpiece surface through the monitoring element.

2. The method according to claim 1, wherein the step of contacting the workpiece surface with an abrasive article comprises:

(a) contacting the workpiece surface with an abrasive article, the abrasive article comprising:

(i) a monitoring element for passage of radiation therethrough, the monitoring element being an area devoid of abrasive composites.

3. The method according to claim 1, wherein the step of contacting the workpiece surface with an abrasive article comprises:

(a) contacting the workpiece surface with an abrasive article, the abrasive article comprising:

(i) a textured abrasive coating having a plurality of abrasive particles dispersed in a binder, the textured abrasive coating adhered to a backing; and (ii) a monitoring element for passage of radiation therethrough, the monitoring element extending from a first edge of the abrasive article to a second opposite edge of the abrasive article.

4. The method according to claim 3, wherein the step of contacting the workpiece surface with an abrasive article comprises:

(a) contacting the workpiece surface with an abrasive article, the abrasive article comprising:

(i) a monitoring element for passage of radiation therethrough, the monitoring element extending in a sinusoidal pattern along the length of the abrasive article.

5. The method according to claim 3, wherein the step of contacting the workpiece surface with an abrasive article comprises:

(a) contacting the workpiece surface with an abrasive article, the abrasive article comprising:

(i) an extended length of abrasive article having a longitudinal length; and (ii) a monitoring element for passage of radiation therethrough, the monitoring element extending along the longitudinal length of the abrasive article.

6. The method according to claim 1, wherein the step of contacting the workpiece surface with an abrasive article comprises:

(a) contacting the workpiece surface with an abrasive article, the abrasive article comprising:

(i) a monitoring element for passage of radiation therethrough, the monitoring element being a discrete area in the abrasive coating of the abrasive article.

7. The method according to claim 6, wherein the step of contacting the workpiece surface with an abrasive article comprises:

(a) contacting the workpiece surface with an abrasive article, the abrasive article comprising:

(i) a monitoring element for passage of radiation therethrough, the discrete area having a shape selected from a square, rectangle, circle, or ellipse.

8. The method according to claim 1, wherein the step of determining a degree of surface modification comprises:

(i) measuring a first radiation level from the workpiece surface;

(ii) measuring a second radiation level from the workpiece surface; and (iii) comparing the first radiation level and the second radiation level.

9. The method according to claim 1, wherein the step of determining a degree of surface modification comprises:

(i) measuring a first radiation level with a first sensor through a first monitoring element; and (ii) measuring a second radiation level with a second sensor through a second monitoring element.

10. The method according to claim 1, wherein the step of determining a degree of surface modification comprises:

(i) measuring a thermal radiation level from the workpiece surface.

11. The method according to claim 1, wherein the step of determining a degree of surface modification comprises:

(i) measuring a visible light level from the workpiece surface.

12. The method according to claim 1, wherein the step of determining a degree of surface modification comprises:

(i) measuring an ultraviolet light level from the workpiece surface.

13. The method according to claim 1, wherein the step of determining a degree of surface modification comprises:

(i) measuring a first radiation level emitted from the workpiece surface.

14. The method according to claim 1, wherein the step of determining a degree of surface modification comprises:

(i) measuring a first radiation level reflected by the workpiece surface.

15. The method according to claim 1, wherein the step of determining a degree of surface modification comprises:

(i) measuring a first radiation level passing through the workpiece.

16. The method according to claim 1, wherein the step of contacting the workpiece surface with an abrasive article comprises:

(a) contacting the workpiece surface with an elongate abrasive article.

17. The method according to claim 1, wherein the step of contacting the workpiece surface with an abrasive article comprises:

(a) contacting the workpiece surface with an abrasive article having a shape selected from a disc, square, rectangle, pentagon, hexagon, octagon, and ellipse.

* * * * *

UNITED STATES PATENT AND TRADEMARK OFFICE

CERTIFICATE OF CORRECTION

PATENT NO. : 6,604,985 B2 
DATED : August 12, 2003
INVENTOR(S) : Michael J. Muilenburg It is certified that error appears in the above-identified patent and that said Letters Patent is hereby corrected as shown below:

Column 2,
Line 28, “about a 50%” should read -- about 50% --.

Column 3,
Line 37, “can be continuous” should read -- can be continuously --.

Column 4,
Line 14, “view of a system an” should read -- view of a system for making an --.

Column 5,
Line 9, “adsorption” should read -- absorption --.

Column 7,
Line 6, “long the interval” should read -- long as the interval --.

Column 8,
Line 67, “clear the least” should read -- clear or at least --.

Column 11,
Line 52, “product” should read -- production --.

Signed and Sealed this

Fifteenth Day of June, 2004

JON W. DUDAS
*Acting Director of the United States Patent and Trademark Office*